US009376172B2

(12) United States Patent
Burkett et al.

(10) Patent No.: US 9,376,172 B2
(45) Date of Patent: Jun. 28, 2016

(54) SPRING LOADED VERTICAL AND HORIZONTAL SELF ALIGNING ROLLER CHOCK

(71) Applicant: W. W. Patterson Company, Pittsburgh, PA (US)

(72) Inventors: Jonathan Burkett, Pittsburgh, PA (US); Taylor C Grapes, Pittsburgh, PA (US)

(73) Assignee: W.W. PATTERSON COMPANY, Wexford, PA (US)

( * ) Notice: Subject to any disclaimer, the term of this patent is extended or adjusted under 35 U.S.C. 154(b) by 0 days.

(21) Appl. No.: 14/640,277

(22) Filed: Mar. 6, 2015

(65) Prior Publication Data

US 2015/0266547 A1 Sep. 24, 2015

Related U.S. Application Data

(60) Provisional application No. 61/949,413, filed on Mar. 7, 2014.

(51) Int. Cl.
*B63B 21/10* (2006.01)

(52) U.S. Cl.
CPC ..... *B63B 21/10* (2013.01)

(58) Field of Classification Search
CPC ..... B63B 21/10
USPC ..... 114/218, 220; 254/394–395
See application file for complete search history.

(56) References Cited

U.S. PATENT DOCUMENTS 24,810 A * 7/1859 Knowlton ..... B63B 21/045 114/218
78,964 A * 6/1868 Haskins ..... B63B 21/045 114/218
3,407,011 A * 10/1968 Zeidler ..... F16C 29/045 248/55
4,154,428 A * 5/1979 Merry ..... B63B 21/10 114/218
D253,161 S * 10/1979 Lindsay ..... D8/356
4,292,911 A * 10/1981 Lindsay ..... B63B 21/10 114/218
4,479,453 A * 10/1984 Bonassi ..... B63B 21/10 114/218
5,149,059 A * 9/1992 Monahan ..... F16H 7/18 254/394
5,421,280 A * 6/1995 Gast ..... B63B 21/10 114/221 R
5,573,226 A * 11/1996 Smith ..... B65H 57/14 226/196.1
6,640,738 B2 * 11/2003 Pierce ..... B63B 21/06 114/218
6,843,196 B1 * 1/2005 Richardson ..... B63B 21/22 114/210
2004/0261687 A1 * 12/2004 Richardson ..... B63B 21/22 114/381
2015/0266547 A1 * 9/2015 Burkett ..... B63B 21/10 114/218

* cited by examiner

*Primary Examiner* — Lars A Olson
*Assistant Examiner* — Jovon Hayes
(74) *Attorney, Agent, or Firm* — Blynn L. Shideler; Krisanne Shideler; BLK Law Group

(57) ABSTRACT

A self-aligning roller chock comprises a deck mounting structure which includes a boss member coupled to the deck and a swivel base plate rotationally coupled to the boss member for rotation about an axis substantially perpendicular to the deck; a pivot assembly coupled to the swivel base plate; a frame coupled to the pivot member and configured to pivot relative to the deck mounting member about the pivot assembly; and a sheave wheel rotationally mounted within the frame adapted to receive rigging line therein. The chock will pivot about two axes providing a self-aligning horizontal and vertical alignment with a resulting force of the rigging line. The self-aligning roller chock may further include a spring coupled to the frame and partially supporting the weight of the frame and the sheave wheel at least when the axis of the sheave wheel is non-parallel to the plane of the deck.

20 Claims, 4 Drawing Sheets

Placing a bite of rope on to the roller chock

SPRING LOADED VERTICAL AND HORIZONTAL SELF ALIGNING ROLLER CHOCK

RELATED APPLICATIONS

This application claims priority to U.S. patent application Ser. No. 61/949,413 filed Mar. 7, 2014, entitled "Spring Loaded Vertical and Horizontal Self-Aligning Roller Chock" which application is incorporated herein by reference in its entirety.

BACKGROUND INFORMATION

1. Field of the Invention

The present invention relates to a self-aligning roller chocks, particularly those used in the barge industries.

2. Background Information

In the barge industry, individual barges are grouped in a barge train and are selectively coupled to towboats and docks. Wire and synthetic ropes are commonly utilized to couple the barges to each other and to the towboat and/or the dock. The reeving of the rope is known as the rigging. On the tow boat deck and/or the dock the rigging lines are often wrapped through a roller chock.

The patent literature discloses some examples of roller chocks such as an 1859 U.S. Pat. No. 24,810 entitled "Cleat", U.S. Pat. No. 4,154,428 entitled "Adjustable Roller Chock", U.S. Pat. No. 4,292,911 entitled "Roller Chock", U.S. Pat. No. D253,161 entitled "Roller Chock", and U.S. Pat. No. 6,640,738 entitled "Bitt with Rotatable Line-handling Surface". These patents are incorporated herein by reference and represent an excellent background.

As barges are loaded and unloaded the level of the barge will vary causing significant changes in the angle on the barge coupled rigging lines. Vertical self-aligning roller chocks have been designed to accommodate various wire rope angles to the load, essentially providing vertical alignment. The existing vertical self-aligning roller chocks are helpful for face and wing wire rigging on barges as the sheave wheel and frame pivots up and down to accommodate both empty and loaded barges. Face rigging is generally rigging wire or rope from the head winches or capstans used to connect the towboat to the barges, while wing rigging are side coupling lines. The original vertical self-aligning roller chock designs were intended to result in reduced wear on both wire rope and sheaves and in addition to towboat decks, they maybe also useful on docks, terminals, and dredges. The existing vertical self-aligning roller chock is considered an upgrade over conventional roller chocks for barge related face wire and wing wire rigging, and commercial examples of such existing vertical self-aligning roller chocks are currently available from Wintech International, LLC of Louisiana.

The developers of the present invention have identified two shortcomings of the existing vertical self-aligning roller chock designs. The first is that the vertical self-alignment is hindered when used with synthetic line due to the light weight of the line. The second is that uneven loading on the existing vertical self-aligning roller chock can often create undue stresses and wear on the lugs and associated hinge pin(s) of the chock. It is an object of the present invention to address these deficiencies of the existing prior art.

SUMMARY OF THE INVENTION

This invention is directed to a cost effective, efficient, self-aligning roller chock that overcomes at least some of the drawbacks of the existing commercial self-aligning roller chock designs.

One embodiment of the present invention provides a self-aligning roller chock including a deck mounting structure configured to be secured to a deck, wherein the deck mounting structure includes a boss member coupled to the deck and a swivel base plate rotationally coupled to the boss member for rotation about an axis substantially perpendicular to the deck; a pivot assembly coupled to the swivel base plate; a frame coupled to the pivot member and configured to pivot relative to the deck mounting member about the pivot assembly; and a sheave wheel rotationally mounted within the frame adapted to receive rigging line therein. The swivel base plate, pivot assembly, frame and sheave wheel will pivot relative to the boss to provide a self-aligning horizontal alignment with a resulting force of the rigging line, and the frame and sheave wheel will pivot relative to the swivel base plate to provide a self-aligning vertical alignment with a resulting force of the rigging line.

One embodiment of the present invention provides a self-aligning roller chock including a deck mounting structure configured to be secured to a deck; a pivot assembly coupled to the deck mounting structure; a frame coupled to the pivot member and configured to pivot relative to the deck mounting member about the pivot assembly; a sheave wheel rotationally mounted within the frame adapted to receive rigging line therein and wherein the frame and sheave wheel will pivot to provide a self-aligning vertical alignment with a resulting force of the rigging line; and a spring coupled to the frame and partially supporting the weight of the frame and the sheave wheel at least when the axis of the sheave wheel is non-parallel to the plane of the deck.

These and other aspects of the present invention will be clarified in the description of the preferred embodiment of the present invention described below in connection with the attached figures in which like reference numerals represent like elements throughout.

BRIEF DESCRIPTION OF THE PREFERRED EMBODIMENTS

This invention is directed to a cost effective, efficient, self-aligning roller chock 10 that overcomes at least some of the drawbacks of the existing commercial self-aligning roller chock designs.

Figure 1A:
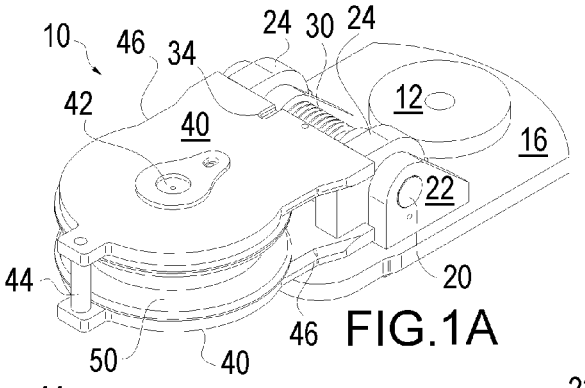
FIGS. 1A-C are top perspective views of self-aligning roller chock according to one embodiment of the present invention.
Figure 1B:
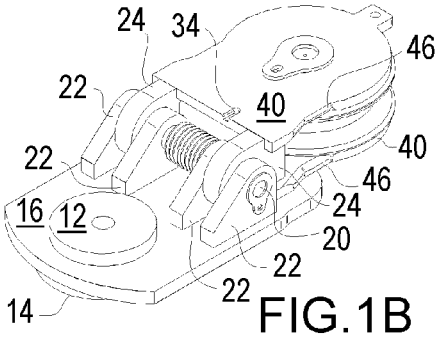
Figure 1C:
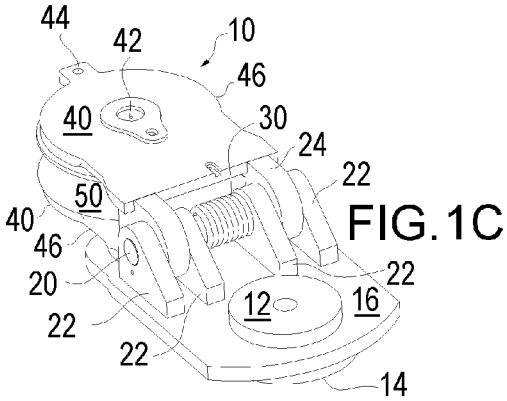
Figure 2A:
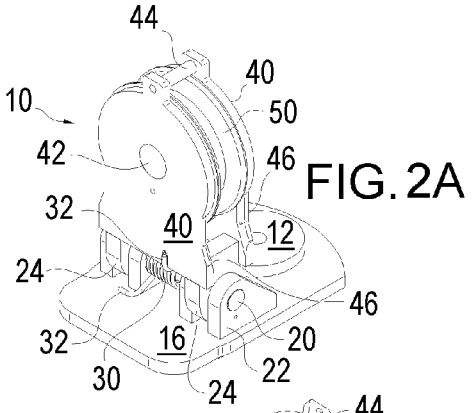
FIGS. 2A-B are top perspective views of the self-aligning roller chock of FIGS. 1A-C with a frame and sheave wheel thereof in a vertical orientation.
Figure 2B:
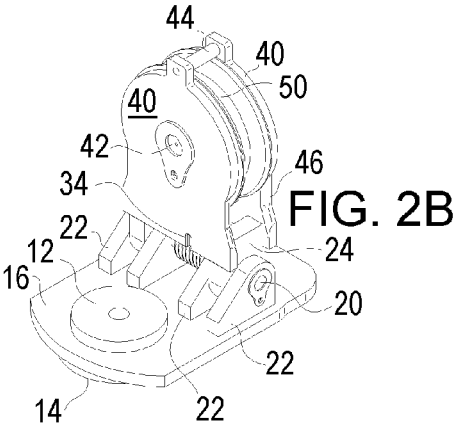
Figure 2C:
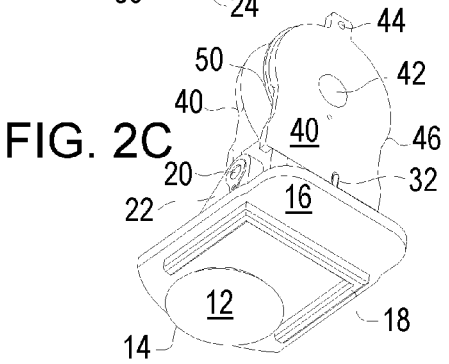
FIG. 2C is a bottom perspective view of the self-aligning roller chock of FIGS. 2A-B.

One embodiment of the present invention is shown in FIGS. 1-2 and provides a self-aligning roller chock 10 which includes a deck mounting structure configured to be secured to a deck.

The self-aligning roller chock 10 is particularly useful for towboats, and the deck generally references this use, but the self-aligning roller chock 10 could be used on docks, barges, terminals, and dredges, as representative examples. Thus the term deck as used herein merely references the mounting surface for the self-aligning roller chock 10 and may be found on a boat surface, dock surface, barge surface, terminal surface, dredge surface, or other applicable mounting location where a self-aligning roller chock 10 would be useful.

The deck mounting structure, generally formed of structural carbon steel, of the embodiments of FIGS. 1-2 and 3 includes a boss member 12 which is coupled to the deck via a deck mounting surface 14. Typically this coupling will be through welding the mounting surface 14 of the member 12 to the surface of the deck, but other attaching techniques could be utilized, such as bolting the member 12 to the deck. The deck mounting structure of the embodiments of FIGS. 1-2 (and 3) includes a swivel base plate 16 rotationally coupled to the boss member 12 for rotation about an axis substantially perpendicular to the deck. The swivel base plate 16 will, as described below, pivot to provide a self-aligning horizontal alignment of the chock 10 with a resulting force 61 of the rigging line 60.

Horizontal alignment within the meaning of this application references orientation of the roller chock 10 in the plane (horizontal plane) parallel to the deck, and this orientation alignment is accomplished through rotation of the plate 16 about an axis perpendicular to the deck through the boss member 12.

The deck mounting structure of the embodiments of the self-aligning roller chock 10 of FIGS. 1-2 (and 3) includes a deck engaging slide member 18 secured to the bottom of the swivel base plate 16. The deck engaging slide member 18 serves as a wear point for the self-aligning roller chock 10 as it slides across the deck during pivoting of the swivel base plate 16 about the boss 12. The slide member 18 also serves to keep the plate 16 level and to accommodate the weld seam about surface 14 of the boss member 12.

The slide member 18 includes a bevel end leading to the deck engaging surface thereof to assist the plate 16 in moving over imperfections in the deck surface. The slide member 18 can be effectively formed as semi-round bar stock welded to the bottom of the plate 16. The block "U" shape design for the slide member 18 in plan view provides a stable support for the plate 16 but other configurations could easily be implemented, such as a "V" shape, rounded "U" shape, semi-ellipse shape, etc.

The self-aligning roller chock 10 includes a pivot assembly coupled to the swivel base plate 16. The pivot assembly includes a plurality of deck mounting structure lugs 22 secured to the swivel plate 16 and a plurality of frame lugs 24 secured to the frame (discussed below). The pivot assembly includes a pivot pin 20 extending along a pivot axis held in the lugs 22 and 24.

The lugs 22 will typically be welded to the swivel plate 16. The lugs 24 may also be welded or bolted in position on the frame. A single pivot pin 20 is shown, but a pair of aligned pins could also easily be used. The single pin design allows for simple mounting of the torsion spring 30 discussed below. Further the number of lugs 22 and 24 could be easily reversed (i.e. by having two single lugs 22 each be bracketed by a pair of lugs 24).

The self-aligning roller chock 10 includes the frame coupled to the pivot member via lugs 24 and configured to pivot relative to the deck mounting member about the pivot assembly to provide for a self-aligning vertical alignment of the chock 10 with a resulting force 61 of the rigging line 60.

Vertical alignment within the meaning of this application references orientation of the roller chock 10 in a plane (a vertical plane) perpendicular to the deck and perpendicular to the axis of the pivot pin 20, and this orientation alignment is accomplished through rotation of the frame and associated elements about the pivot pin 20. This vertical alignment is essentially the same as in the existing vertical self aligning roller chocks.

One important aspect of the embodiments of roller chocks 10 of FIGS. 1-2 and 4 is the inclusion of a spring 30 coupled to the frame and partially supporting the weight of the frame and the weight of the sheave wheel 50 at least when the axis of the sheave wheel 50 is non-parallel to the plane of the deck. This will described further below, following a further description of the frame construction.

The frame includes a pair of spaced frame plates 40 on opposed sides of the sheave wheel 50. The spaced frame plates 40 will typically be structural carbon steel and the lugs 24 may be welded or bolted thereto, with the lugs serving as a spacing member for the plates 40. Hub structure 42 is coupled to the frame plates 40 and serves as a rotational hub for the sheave wheel and may also act as a spacer for the plates 40. It is preferred if the hub structure is bolted in position for easy removal as discussed below. The frame also includes a spacer bolt 44 spacing the frame plates together. Additional spacing members could be provided, however the bolt 44 and the lugs 24 are generally sufficient, and the hub structure 42 may also form spacing functions.

The frame plate 40 includes beveled recess cutouts 46 which are provided to minimize stress on the wire rope or line 60 where such line 60 does pull out of the sheave wheel 50 (which may happen during loading, or if the lines 60 in and out of the sheave wheel 50 are not in the same plane). The self-alignment features of the roller chock 10 are designed to minimize this occurrence, but such rope positioning may still occur, and cutouts 46 minimize line stress and damage during such occurrences.

Figure 5:
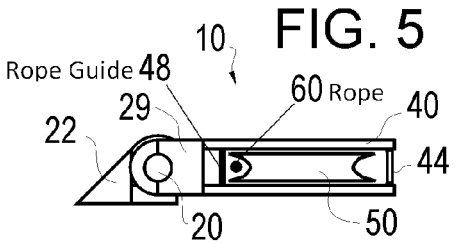
FIG. 5 is a schematic sectional view of the self-aligning roller chocks according to the present invention.

The frame additionally includes a rope guide 48 mounted between the frame plates 40 adjacent the sheave wheel 50 as shown in cross section in FIG. 5. The rope guide 48 can follow the curve of the sheave wheel 50 and is configured to prevent the rope 60 moving between the sheave wheel 50 and one frame plate 40.

Specifically in operation the frame will be vertically aligned with the plane of the load 61, if the tension on the line is slackened (which occurs for any of a myriad of reasons), then gravity will otherwise allow the line 61 to drop out of the sheave wheel groove and the frame will drop. Tensioning, again, the line could otherwise cause the line to become wedged between the sheave wheel 50 and the upper side plate 40, particularly with synthetic rope. The issue is less pronounced with wire rope which is less compressible than synthetic rope. The trough shaped rope guide 48 prevents the rope 60 from moving between the sheave wheel 50 and one frame plate 40 during such tensioning.

The sheave wheel 50 is a grooved sheave wheel which may effectively be formed of a material known as NYLATRON GSM. This synthetic material is preferable because of its strength, durability and its non corrosion properties. This material prevents the roller chock sheave wheel 50 from becoming rough and abrasive due to corrosion of the material, which may be particularly helpful when using synthetic tug ropes and lines because it helps to prevent them from abrading and wearing out. The construction of the sheave wheel 50 and hub structure 42 is generally known in the art and need not be elaborated further here.

Returning to the spring 30 construction, the roller chock 10 allows such a spring to be easily formed as at least one torsion spring mounted around the pivot pin 20. The opposed ends or legs 32 of the spring will rest against the plate 16 and frame plate 40, as shown. The upper frame plate 40 may include a recess 34 for receiving a leg 32 in an alternative orientation in a manner that prevents the leg 32 from being obtrusive. As described below the spring 30 will assist the roller chock 10 in coming to vertical alignment, particularly where synthetic rope is utilized. Preferably the spring 30 is configured to offset a substantial portion of the weight of the frame, generally 60-90% of the weight, more commonly 75-85% of the weight, but not all of the weight of the frame so that the frame can return to the deck surface when the line 60 is removed or substantially slackened.

Further, there is no substantial need of the spring 30 assist when the frame and sheave wheel 50 are vertical (not a likely operating position), so the spring 30 may be designed to have a force exertion between the vertical and horizontal frame position. In other words the spring 30 may be at rest with the frame in the vertical position and loaded when the frame is horizontal.

The roller chock described in FIGS. 1-2 provides a spring loaded vertical and horizontal self-aligning roller chock. The swivel base plate 16, pivot assembly, frame and sheave wheel 50 will pivot relative to the boss 12 to provide a self-aligning horizontal alignment with a resulting force 61 of the rigging line 60 as shown in FIGS. 8D and E, and the frame and sheave wheel 50 will pivot relative to the swivel base plate 16 about pin 20 to provide a self-aligning vertical alignment with a resulting force 61 of the rigging line 60 as shown in FIGS. 7C and D.

Alternative embodiments of the roller chock 10 of the present invention may be applicable for distinct applications and in FIGS. 3 and 4, respectively.

Figure 3A:
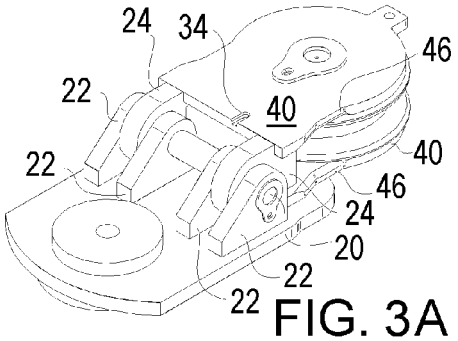
FIGS. 3A-B are top perspective views of self-aligning roller chock according to another embodiment of the present invention.
Figure 3B:
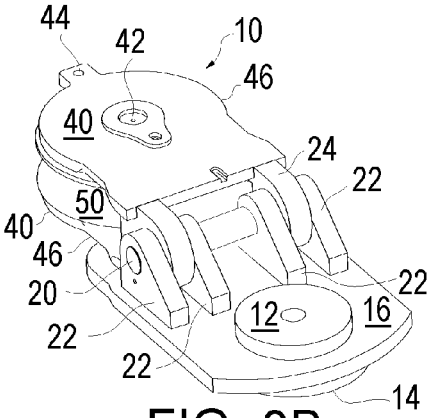

FIGS. 3A-B are top perspective views of self-aligning roller chock 10 according to another embodiment of the present invention, wherein the spring 30 is not included. This embodiment is identical to the embodiment of FIGS. 1-2 except for the exclusion of the spring 30 and is applicable where the spring assist is deemed unnecessary, such as where only wire rope is being utilized. The heavy weight of wire rope for line 60 can more easily move the frame of chock 10 into proper vertical alignment, and thus the additional cost and complexity of the spring 30 may be deemed unnecessary. However, even in applications using only wire rope, the spring assist from spring 30 of FIGS. 1-2 (and 4) is believed to be beneficial in more quickly and easily reaching proper alignment, such that the spring 30 will yield benefits and reduce unwanted stresses and wear on the line 60 and the chock 10.

Figure 4A:
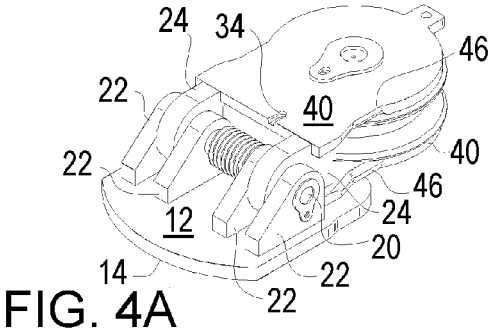
FIGS. 4A-B are top perspective views of self-aligning roller chock according to another embodiment of the present invention.
Figure 4B:
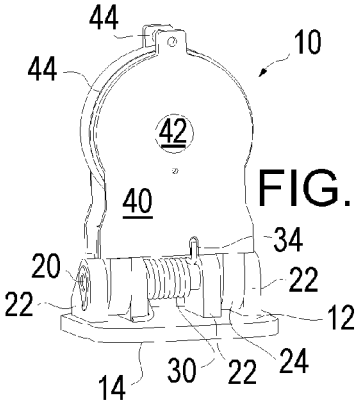
Figure 8A:
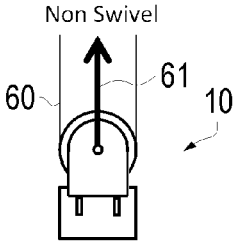
FIGS. 8A-B are schematic representations of stresses on the lugs in the the self-aligning roller chock of FIGS. 4A-B.
Figure 8B:
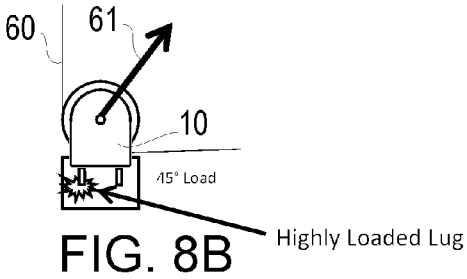

FIGS. 4A-B are top perspective views of self-aligning roller chock 10 according to another embodiment of the present invention, which is designed for applications in which horizontal alignment of the chock 10 is deemed unnecessary, such as where expected loading of the chock 10 is expected to typically be as shown in FIGS. 8A (and 8C). Here the deck mounting structure has the boss member 12 formed as a plate welded to the deck via mounting surface 14 with lugs 22 welded directly to the boss member 12. Where loading such as shown in FIG. 8B is expected to be encountered by the chock 10, then the inclusion of horizontal alignment features of the chocks of FIGS. 1-3 is desirable to avoid excessive, and potentially dangerous loading on Lugs 22 and 24.

Figure 6A:
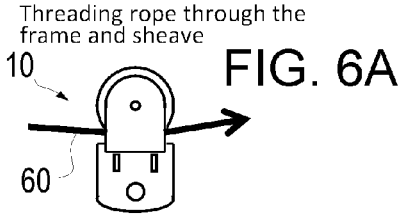
FIGS. 6A-E are schematic representations of the loading of the rope line on the self-aligning roller chocks according to the present invention.

FIGS. 6A-E are schematic representations of the loading of the rope line 60 on the self-aligning roller chocks 10 according to the present invention. FIG. 6A illustrates the loading of the rope line 60 on the self-aligning roller chocks 10 via threading of a leading end through the sheave wheel 50 and frame, between the sheave wheel 50 and the guide 48, which loading is generally easily understood.

Figure 6B:
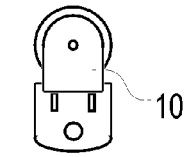
Figure 6C:
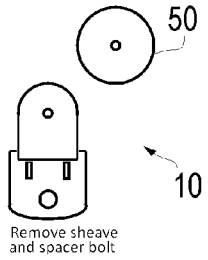
Figure 6D:
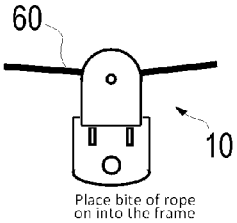
Figure 6E:
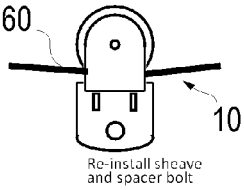

It is not always desirable to retrieve a leading end of the line 60 for loading of a roller chock 10 and FIGS. 6B-E are schematic representations of the loading of a bite of the rope line 60 (i.e. an intermediate portion of the line 60) on the self-aligning roller chocks 10. The chock 10 is shown in FIG. 6B and then the spacer bolt 44 and hub 42 is removed, preferably by bolts to allow the sheave wheel 50 to be slid out as shown in FIG. 6C. The line 60 is then placed in the frame as shown in FIG. 6D and the sheave wheel 50 re-attached as shown in FIG. 6C to complete the loading of the bit of rope 60. The rapid removal of the spacer bolt 44 and the hub 42, via bolts, allows for the rapid bit loading of FIGS. 6B-E.

An alternative arrangement is to have the upper frame plate 40 bolted to the lugs 24 so the upper frame plate 40 could be easily removed, leaving the sheave wheel 50, hub 42, spacer bolt 44 in place on the other frame plate 40 for loading of the bit of rope 60.

Figure 7A:
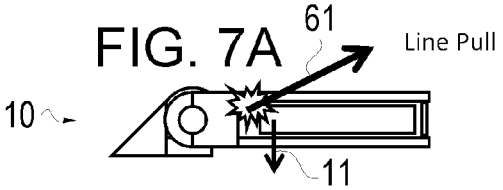
FIGS. 7A-B are schematic representations of the vertical self alignment of the self-aligning roller chock of FIGS. 3A-B.
Figure 7B:
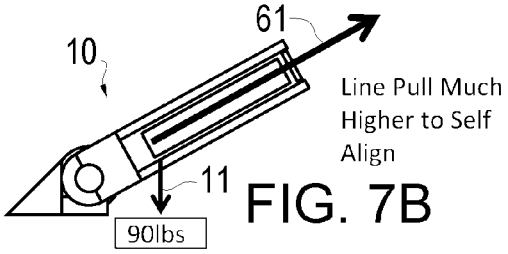
Figure 7C:
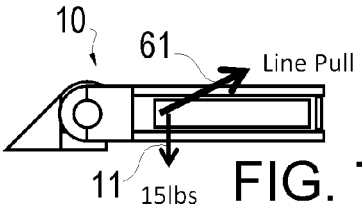
FIGS. 7C-D are schematic representations of the vertical self alignment of the self-aligning roller chock of FIGS. 1-2 and 4.
Figure 7D:
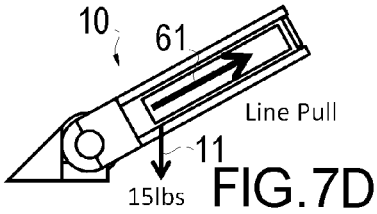

FIGS. 7A-B are schematic representations of the vertical self-alignment of the self-aligning roller chock 10 of FIGS. 3A-B which omits the spring assist of spring 30. As the line force 61 of line 60 begins to elevate as shown in FIG. 7A the line force 61 will overcome the weight of the frame and sheave wheel 50, which in this embodiment is effectively about 90 LBS, to provide the vertical alignment shown in FIG. 7B. FIGS. 7C-D are schematic representations of the vertical self-alignment of the self-aligning roller chock 10 of FIGS. 1-2 and 4. Again as the line force 61 of line 60 begins to elevate as shown in FIG. 7C the line force 61 will overcome the effective weight of the frame and sheave wheel 50, which in this embodiment is effectively about 15 LBS due to the assist of spring 30, to provide the vertical alignment shown in FIG. 7D.

Figure 8C:
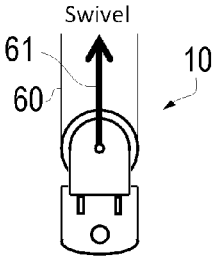
FIGS. 8C-E are schematic representations of the horizontal self alignment of the self-aligning roller chock of FIGS. 1-3.
Figure 8D:
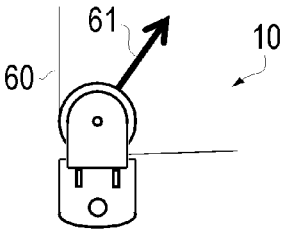
Figure 8E:
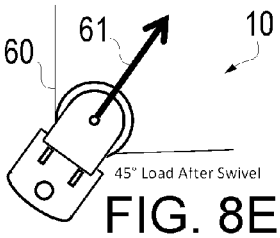

As discussed above, FIGS. 8A-B are schematic representations of stresses on the lugs 22 and 24 in the self-aligning roller chock 10 of FIGS. 4A-B. FIGS. 8C-E are schematic representations of the horizontal self-alignment of the self-aligning roller chock of FIGS. 1-3. As discussed above, all embodiments of the chocks 10 can easily accommodate balanced loading shown in FIGS. 8A and 8C, however unbalanced loading shown in 8B and 8D can cause undue stresses on the lugs 22 and 24 unless horizontal alignment is accommodated as in the embodiments of FIGS. 1-3. In the embodiments of FIGS. 1-3, loading such as shown in FIG. 8D will result in a balance of the loading via horizontal pivoting of the chock to the balanced position of FIG. 8E.

It is apparent that many variations to the present invention may be made without departing from the spirit and scope of the invention. The present invention is defined by the appended claims and equivalents thereto.

What is claimed is:

1. A self-aligning roller chock comprising:

A) A deck mounting structure configured to be secured to a deck;

B) A pivot assembly coupled to the deck mounting structure;

C) A frame coupled to the pivot member and configured to pivot relative to the deck mounting member about the pivot assembly;

D) A sheave wheel rotationally mounted within the frame adapted to receive rigging line therein and wherein the frame and sheave wheel will pivot to provide a self-aligning vertical alignment with a resulting force of the rigging line; and E) A spring coupled to the frame and partially supporting the weight of the frame and the sheave wheel at least when the axis of the sheave wheel is non-parallel to the plane of the deck.

2. The self-aligning roller chock according to claim 1 wherein the deck mounting structure includes a boss member coupled to the deck and a swivel base plate rotationally coupled to the boss member for rotation about an axis substantially perpendicular to the deck, wherein the pivot assembly is coupled to the swivel base plate and wherein the pivot assembly, frame and sheave wheel will pivot to provide a self-aligning horizontal alignment with a resulting force of the rigging line.

3. The self-aligning roller chock according to claim 2 further including a deck engaging slide member secured to the bottom of the swivel base plate.

4. The self-aligning roller chock according to claim 3 wherein the deck engaging slide member includes a bevel end leading to the deck engaging surface thereof.

5. The self-aligning roller chock according to claim 1 wherein the pivot assembly includes a plurality of deck mounting structure lugs secured to the deck mounting structure, a plurality of frame lugs secured to the frame, and at least one pivot pin along a pivot axis held in the lugs and wherein the spring is formed as at least one torsion spring mounted around at least one pivot pin.

6. The self-aligning roller chock according to claim 1 wherein the frame includes a pair of spaced frame plates on opposed sides of the sheave wheel.

7. The self-aligning roller chock according to claim 6 wherein at least one of a frame plate or the sheave wheel is configured for removal to allow for loading a bite of rope on the roller chock.

8. The self-aligning roller chock according to claim 6 further including a rope guide mounted between the frame plates adjacent the sheave wheel which is configured to prevent the rope moving between the sheave wheel and one frame plate.

9. The self-aligning roller chock according to claim 6 wherein at least one frame plate includes beveled cutouts adjacent the pivot assembly.

10. A self-aligning roller chock comprising:

A) A deck mounting structure configured to be secured to a deck, wherein the deck mounting structure includes a boss member coupled to the deck and a swivel base plate rotationally coupled to the boss member for rotation about an axis substantially perpendicular to the deck;

B) A pivot assembly coupled to the swivel base plate;

C) A frame coupled to the pivot member and configured to pivot relative to the deck mounting member about the pivot assembly;

D) A sheave wheel rotationally mounted within the frame adapted to receive rigging line therein, and i) wherein the swivel base plate, pivot assembly, frame and sheave wheel will pivot relative to the boss to provide a self-aligning horizontal alignment with a resulting force of the rigging line, and ii) wherein the frame and sheave wheel will pivot relative to the swivel base plate to provide a self-aligning vertical alignment with a resulting force of the rigging line.

11. The self-aligning roller chock according to claim 10 further including a spring coupled to the frame and partially supporting the weight of the frame and the sheave wheel at least when the axis of the sheave wheel is non-parallel to the plane of the deck.

12. The self-aligning roller chock according to claim 10 further including a deck engaging slide member secured to the bottom of the swivel base plate.

13. The self-aligning roller chock according to claim 12 wherein the deck engaging slide member includes a bevel end leading to the deck engaging surface thereof.

14. The self-aligning roller chock according to claim 10 wherein the pivot assembly includes a plurality of deck mounting structure lugs secured to the deck mounting structure, a plurality of frame lugs secured to the frame, and at least one pivot pin along a pivot axis held in the lugs.

15. The self-aligning roller chock according to claim 10 wherein the frame includes a pair of spaced frame plates on opposed sides of the sheave wheel.

16. The self-aligning roller chock according to claim 15 wherein at least one frame plate or the sheave wheel is configured for removal to allow for loading a bite of rope on the roller chock.

17. The self-aligning roller chock according to claim 15 further including a rope guide mounted between the frame plates adjacent the sheave wheel which is configured to prevent the rope moving between the sheave wheel and one frame plate.

18. The self-aligning roller chock according to claim 15 wherein at least one frame plate includes beveled cutouts adjacent the pivot assembly.

19. The self-aligning roller chock according to claim 15 further including a spring coupled to the frame and partially supporting the weight of the frame and the sheave wheel at least when the axis of the sheave wheel is non-parallel to the plane of the deck.

20. The self-aligning roller chock according to claim 19 wherein at least one frame plate is configured for removal to allow for loading a bite of rope on the roller chock, and further including a rope guide mounted between the frame plates adjacent the sheave wheel which is configured to prevent the rope moving between the sheave wheel and one frame plate.

* * * * *